US007496179B2

(12) United States Patent
Freudenberger et al.

(10) Patent No.: US 7,496,179 B2
(45) Date of Patent: Feb. 24, 2009

(54) X-RAY UNIT HAVING AN X-RAY RADIATOR WITH A THERMIONIC PHOTOCATHODE AND A CONTROL CIRCUIT THEREFOR

(75) Inventors: Joerg Freudenberger, Eckental (DE); Sven Fritzler, Erlangen (DE); Manfred Fuchs, Nürnberg (DE); Matthias Maier, Nürnberg (DE); Detlef Mattern, Erlangen (DE); Peter Roehrer, Uttenreuth (DE); Peter Schardt, Höchstadt A.D. Aisch (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/752,423

(22) Filed: May 23, 2007

(65) Prior Publication Data

US 2007/0274452 A1 Nov. 29, 2007

(30) Foreign Application Priority Data

May 24, 2006 (DE) ..... 10 2006 024 436

(51) Int. Cl.
*H01J 35/06* (2006.01)
*H05G 1/36* (2006.01)
*H05G 1/46* (2006.01)

(52) U.S. Cl. ..... 378/122; 378/118; 378/136; 378/144

(58) Field of Classification Search ..... 378/118, 378/122, 136, 144
See application file for complete search history.

(56) References Cited

U.S. PATENT DOCUMENTS 4,426,720 A * 1/1984 Friedel ..... 378/93
4,821,305 A 4/1989 Anderson
5,077,771 A * 12/1991 Skillicorn et al. ..... 378/102
5,504,796 A * 4/1996 Da Silveira et al. ..... 378/121
5,621,781 A * 4/1997 Blake et al. ..... 378/138
5,768,337 A 6/1998 Anderson (Continued)

FOREIGN PATENT DOCUMENTS

DE G 87 13 042.4 3/1989

(Continued)

*Primary Examiner*—Edward J Glick
*Assistant Examiner*—Thomas R Artman
(74) *Attorney, Agent, or Firm*—Schiff Hardin LLP

(57) ABSTRACT

An x-ray unit has an x-ray radiator having an anode that emits x-rays upon being struck by electrons, a cathode that thermionically emits electrons upon irradiation thereof by a laser beam, electrical connections for application of a high voltage between the anode and the cathode to accelerate the emitted electrons toward the anode as an electron beam, a vacuum housing that can be rotated around an axis, an insulator that is part of the vacuum housing and that separates the cathode from the anode, a drive that rotates the vacuum housing around its axis, an arrangement for cooling components of the x-ray radiator, and an arrangement that directs the laser beam from a stationary source, arranged outside of the vacuum housing, onto a spatially stationary laser focal spot on the cathode and that focuses the laser beam. The x-ray unit furthermore has a control circuit with which an operating property of the x-ray unit is adjusted and at least one measurement element for measurement of a measurement quantity is effectively correlated with the temperature of the cathode. The control circuit adjusts the operating property dependent on the measurement of the measurement quantity.

4 Claims, 2 Drawing Sheets

U.S. PATENT DOCUMENTS

| | | | | |
|---|---|---|---|---|
| 6,282,260 | B1 * | 8/2001 | Grodzins | 378/87 |
| 6,556,651 | B1 | 4/2003 | Thomson et al. | |
| 7,027,560 | B2 * | 4/2006 | Kindlein | 378/141 |
| 7,085,351 | B2 * | 8/2006 | Lu et al. | 378/122 |
| 2004/0028183 | A1 | 2/2004 | Lu et al. | |

FOREIGN PATENT DOCUMENTS

| | | | |
|---|---|---|---|
| EP | 0 147 009 | | 12/1989 |
| JP | 09063468 | A * | 3/1997 |
| WO | WO 2005/112070 | | 11/2005 |

* cited by examiner

X-RAY UNIT HAVING AN X-RAY RADIATOR WITH A THERMIONIC PHOTOCATHODE AND A CONTROL CIRCUIT THEREFOR

BACKGROUND OF THE INVENTION

Field of the Invention

The invention concerns an x-ray unit that includes an x-ray radiator and control components therefor, the x-ray radiator being of the type having an anode and a cathode having a surface that emits electrons upon laser irradiation thereof. The invention also concerns a method for operation of such an x-ray unit.

High-capacity x-ray radiators typically have an anode that is mounted to rotate in order to ensure a high thermal loading capability of the anode during generation of x-rays with high radiation power.

DE 87 13 042 U1 describes an x-ray tube with an evacuated housing (the housing is evacuated in order to be mounted such that it can be rotated around a rotation axis) in which a cathode and an anode are arranged. The cathode and the anode are connected in a fixed manner with the housing. The x-ray tube has drive means for rotation of the housing around the rotation axis. A deflection system that is stationary relative to the housing deflects an electron beam proceeding from the cathode to the anode such that it strikes the anode on an annular impact surface, the axis of this annular impact surface corresponding to the rotation axis that runs through the cathode. Since the anode is connected in a heat-conductive manner with the wall of the housing, heat dissipation from the anode to the outer surface of the housing is ensured. An effective cooling is possible via a coolant that is admitted to the housing.

In this arrangement a relatively long electron flight path is present due to the axis-proximal position of the cathode and the axis-remote position of the impact surface of the anode. This creates problems in the focusing of the electron beam. Among other things, a problem occurs in the generation of soft x-ray radiation given which a comparably low voltage is applied between cathode and anode. Due to the lower kinetic energy of the electrons, a higher defocusing of the electron beam occurs, dependent on the space charge limitation. The use of such an x-ray tube is possible only in a limited manner for specific applications (such as, for example, mammography).

U.S. Pat. No. 4,821,305 discloses an x-ray tube is described in which both the anode and the cathode are arranged axially symmetrically in a vacuum housing that can be rotated as a whole around an axis. The cathode is thus mounted so it can rotate and has an axially symmetrical surface made of a material that photoelectrically emits electrons upon exposure to light of appropriate power (photoelectrons). The electron emission is triggered by a spatially stationary light beam that is focused from the outside of the vacuum housing through a transparent window onto the cathode.

The practical feasibility of this concept, however, appears to be questionable due to the quantum efficiency of available photo-cathodes and the light power that is required. Given use of high light power, the cooling of the photo-cathode requires a considerable expenditure due to its rather low heat resistance. In view of the vacuum conditions that exist in x-ray tubes, the surface of the photo-cathode is additionally subjected to oxidation processes, which limits the durability of such an x-ray tube.

In U.S. Pat. No. 5,768,337, a photomultiplier is interposed between a photo-cathode and the anode in a vacuum housing in which the photo-cathode and the anode are arranged. Thus, a lower optical power is necessary for generation of x-ray radiation. The longer electron flight path with repeated deflection of the electron beam between the dynodes, however, requires a high expenditure for focusing the beam.

An x-ray scanner (in particular a computed tomography scanner) is known from EP 0 147 009 B1. X-rays are thereby generated by an electron beam striking an anode. Among other things, the possibility is mentioned to generate the electron beam by thermionically-emitted electrons by heating the cathode surface with a light beam. The surface of the cathode should be capable of being heated and cooled quickly in the disclosed embodiment of the cathode with a substrate layer made of a material with high heat conductivity, but this appears to be problematic with regard to the light power that is required.

U.S. Pat. No. 6,556,651 describes a system for generation of therapeutic x-rays. Among other things, the possibility is generally mentioned that the electron beam required for the generation of x-ray radiation is emitted by a thermionic cathode heated by a laser.

An x-ray radiator with stationary cathode is known from U.S. Application Publication No. 2004/028183 A1, wherein an electron emission current and an x-ray energy can be controlled independently by adaptation of the distance between cathode and anode, adaptation of the temperature of the cathode, optical excitation of the cathode, and adaptation of the high voltage between the cathode and the anode. In one embodiment this can occur by controlling a photon source that emits photons that liberate electrons upon impact on the cathode.

Given non-pulsed use of a laser for generation of x-rays, the risk exists that not only the laser focal spot will be severely heated (as is desired), but also that the average temperature will rise too severely. When a continuous laser is operated with constant power, the temperature rise brought about by it will likewise be constant. Because the electron emission density is a function of the temperature, the x-ray flow can be too large; for example, given use as a medical x-ray radiator it can cause an unnecessary dose exposure for the patient during the duration of an examination. If a rotating cathode is used that is struck by the laser beam, the danger exists there that the entire cathode focal path will ramp up in terms of temperature during a number of rotations, with the same consequences.

SUMMARY OF THE INVENTION

An object of the present invention is to provide an x-ray unit having a laser-activated x-ray radiator suitable for use as, for example, in medical radiology, with which an optimization or control of the x-ray flow is enabled, in particular with regard to achieving a constant radiation power.

This object is achieved in accordance with the invention by an x-ray unit having a radiation source, composed basically of a laser and an x-ray radiator, wherein the x-ray radiator has an anode that emits x-rays upon being struck by electrons, and a cathode that thermionically emits electrons upon irradiation thereof by a laser beam, a voltage source that applies a voltage between the anode and the cathode for acceleration of the emitted electrons toward the anode to form an electron beam. The x-ray radiator furthermore has a vacuum housing that can be rotated around an axis, an insulator that separates the cathode from the anode, a drive for rotation of the vacuum housing around its axis, a cooling arrangement for cooling components of the x-ray radiator and a laser source that directs a laser beam from a stationary location (simply designated in the following as a laser) outside of the vacuum housing onto a spatially stationary laser focal spot on the cathode and that focuses the laser beam. The x-ray unit also has a control circuit in connection with the x-ray radiator, with which an operating property of the x-ray radiator can be adjusted, as well as at least one measurement element that measures a measurement quantity that is effectively correlated with the temperature of the cathode. The control circuitry adjusts the aforementioned operating property dependent on the measured measurement quantity.

In an embodiment the control circuit is connected with the radiation source in a manner that allows at least one emission property of the radiation source to be adjusted or can be altered by the control circuit. Possible emission properties are one or more of the radiation power, the laser power, the size of the laser focal spot, and the frequency characteristic of the radiation. For example, if the anode current is too high given constant radiation power, the laser power can be reduced.

In a further (alternative or additional) embodiment, the control circuit is connected with the drive that rotates the vacuum housing, so the rotation speed can be adjusted. For example, if the anode current is too high given constant laser power, the rotation speed can be increased.

In a further (alternative or additional) embodiment, the control circuit is connected a beam deflector that operates to deflect the path of the incident laser beam. The beam intensity per area unit thus can be decreased, thus producing a reduction in the temperature of the laser beam focal spot. For example, the laser beam can be spatially wobbled, meaning that it spatially jumps or is moved back and forth. It can be moved laterally back and forth in a radial direction (relative to the focal path), for example at approximately 2 Hz. The focal path is thereby effectively expanded in a controllable manner and the peak radiation power per area unit is decreased.

The measurement element can measure the x-ray tube current between the cathode and the anode and/or the x-ray flow (x-ray flux) in a selected direction, in particular a direction used for radioscopy. A number of measurement different elements also can be used.

A corresponding control or regulatory loop can be developed with the arrangement described above, wherein the measurement value (typically the regulatory value) output to the control circuit by the measurement element is adapted to a specific control valve (reference variable) by adjustment of the operating property/operating parameter of the x-ray unit. If, for example, a measured x-ray tube current that flows through the vacuum between cathode and anode at a particular applied high voltage is too large, an electric/digital signal can reduce the injected (launched) laser power. Alternatively or additionally, the measurement of the x-ray flow on the detector side can be used. An adaptation of the dose power as a function of the radioscopy direction of a patient is thereby possible.

A further technique for stabilization of the laser power is to the cathode focal path using "short-term excessive" laser power. The temperature rise at the laser focus is thereby reduced/optimized during the actual examination.

It is advantageous for the modulation time of the laser power to be between 1 μs and 1 s, since the regulatory circuit then can be operated in real time.

The inventive x-ray unit allows a sufficiently high electron current density to be achieved using laser powers as are generated by diode or solid-state lasers.

DESCRIPTION OF THE PREFERRED EMBODIMENTS

Figure 1:
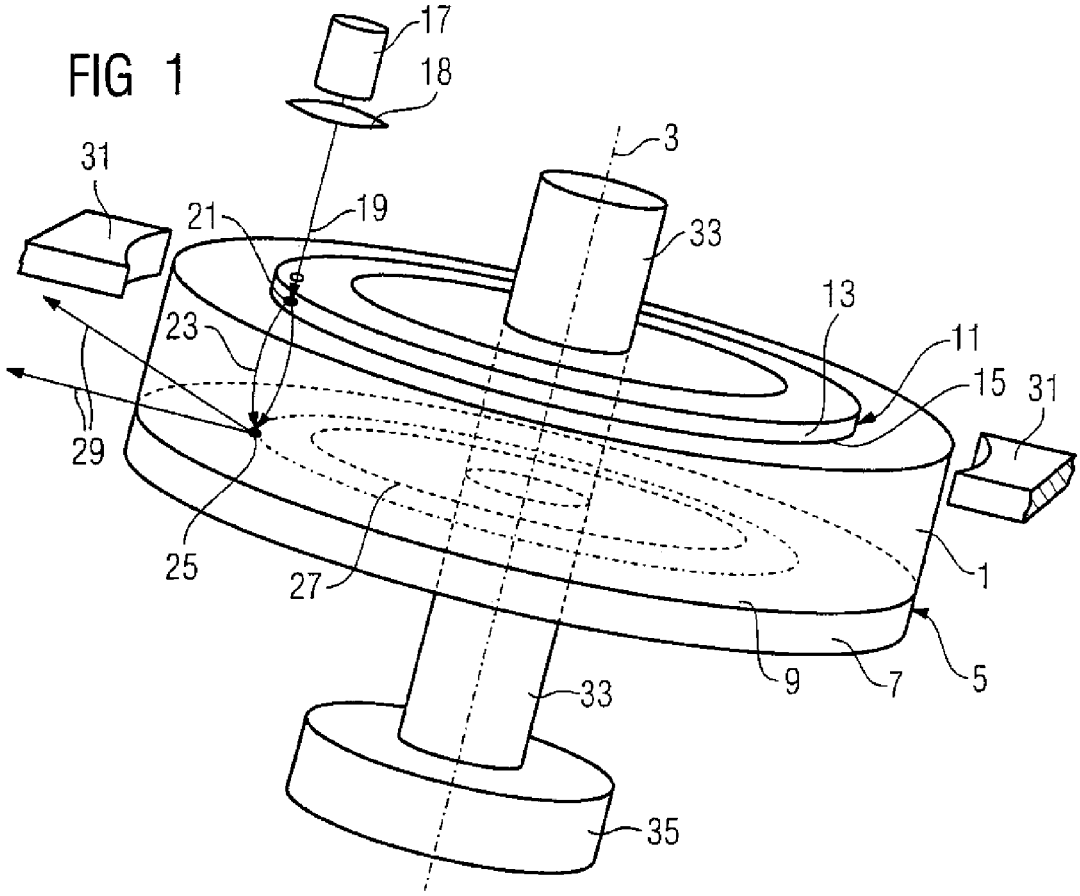
FIG. 1 schematically illustrates a vacuum housing of an x-ray radiator used in an x-ray unit in accordance with the invention.

A three-dimensional representation of a vacuum housing 1 is shown in FIG. 1. The vacuum housing 1 is fashioned as a cylinder (having a cylinder jacket formed of an insulating material) and the cylinder is mounted in a rotationally symmetrical manner on an axis 3. An anode 5 forms a base of the cylinder. The anode 5 has a support layer 7 and an annularly-fashioned surface 9 from which x-rays 29 are emitted. An annularly-fashioned cathode 11 is located in the opposite base of the vacuum housing 1 (cylinder). The cathode 11 has a support layer 13 that is part of the exterior of the vacuum housing 1 and a surface 15 that facing the interior of the vacuum housing 1.

The anode 5 and cathode 11 shown in FIG. 1 are fashioned axially symmetrically, such that the electron beam or the laser beam always strikes the surface of the anode 5, or the cathode 11 during the rotation. However, it can also be advantageous to fashion the anode 5 and the cathode 11 (in particular their support layers 7, 13) such that they exhibit only one axis of symmetry. This means a segmented design of the cathode 11 or the anode 5, such that a rotation of the cathode 11 or of the anode 5 by a whole-number divisor of 360° leads to an identical image of the cathode 11 or of the anode 5; materials of higher mechanical stability that are arranged as spokes in the cathode 11 or in the anode 5 can support segments of materials with high emission efficiency.

The surface 15 of the cathode 11 is formed of a material having a low vapor pressure and a high melting point (such as, for example, tungsten, which is typically used in x-ray cathodes). The carrier layer 13 is optimized with regard to its heat capacity, its heat conductivity and its density such that the temperature of the surface 15 is kept near the temperature required for the thermionic emission of electrons. A lower power of the laser beam 19 is thereby required. In one possible embodiment the support layer 13 is made of the same material as the surface 15, but the material in the support layer 13 is not in a solid, uniform form but rather in a sintered or porous structure. The density, the heat capacitor and/or the heat conductivity of the support layer 13 are thereby reduced in comparison to the surface 15. The temperature of the surface 15 can thereby be kept near to the emission temperature for electrons.

The laser beam is asymmetrically shaped (not shown), so an asymmetrical laser focal spot with different laser power can be generated within the laser focal spot. Laser power can thereby be saved; while approximately equally steeply rising and falling temperature gradients at the edges can be generated at the laser focal spot at the entrance and exit points of the cathode, which leads to an efficient electron emission at a constant level over the laser focal spot.

A laser beam 19 is directed from a spatially stationary light source 17 onto the cathode 11. The light source 17 is typically designed as a diode laser or as a solid-state laser. The laser beam 19 passes through the support layer 13 to strike the surface 15 of the cathode 11 at a laser focal spot 21. The laser beam 19 is varied in terms of its shape, intensity and/or time structure by optics 18, so the electron current strength can be correspondingly varied through the injected laser power. The laser beam thereby can also be split into partial laser beams. In this case each of the partial laser beams generates a partial laser focal spot of which the laser focal spot 21 is composed, thus an asymmetrical laser focal spot can be realized in a simple manner and a heating and cooling can be better controlled by this composite laser focal spot.

When (as in this case) the laser focal spot passes through the support layer 13 from outside of the vacuum housing 1 to strike the surface 15 of the cathode 11, the optics 18 that vary (adjust) the laser beam 19 in terms of its properties are arranged outside of the vacuum housing 1. In the event that (as is shown in FIG. 2) the laser beam enters into the inside of the vacuum housing 1 via an optically transparent window 63, the optics 18 can also be located inside the vacuum housing 1.

Electrons arise from the laser focal spot 21 in the form of an electron cloud and are directed onto the anode in an electron beam 23 by the high voltage applied between the cathode 11 and the anode 5. The electron beam 23 strikes the surface 9 of the anode 5 in a spatially stationary focal spot 25. Due to the rotation of the vacuum housing 1, the arising heat is distributed along the focal ring 27 on the surface 9 of the anode 5. The arising heat is conducted to the outside of the vacuum housing 1 via the support layer 7 of the anode 5.

X-ray radiation 29 is emitted from the focal spot 25, the material being transparent for x-ray radiation 29 at the point of the vacuum housing 1 from which the x-ray radiation 29 exists. A magnet system 31 is located outside of the vacuum housing 1, such that the electron beam 23 can be shaped and directed. Alternatively, an electrostatic arrangement (for example capacitors) with which the electron beam can be shaped and directed can be mounted instead of the magnet system 31. In a third embodiment, the electron beam can be shaped or directed by optical means. A motor 35 that is connected with the vacuum housing 1 via a drive shaft 33 rotates the vacuum housing 1 around its axis 3. The longitudinal axis of the drive shaft 33 coincides with the axis 3 of the vacuum housing 1. Connections to apply a high voltage between the anode 5 and the cathode 11 are located in the drive shaft 33.

Figure 2:
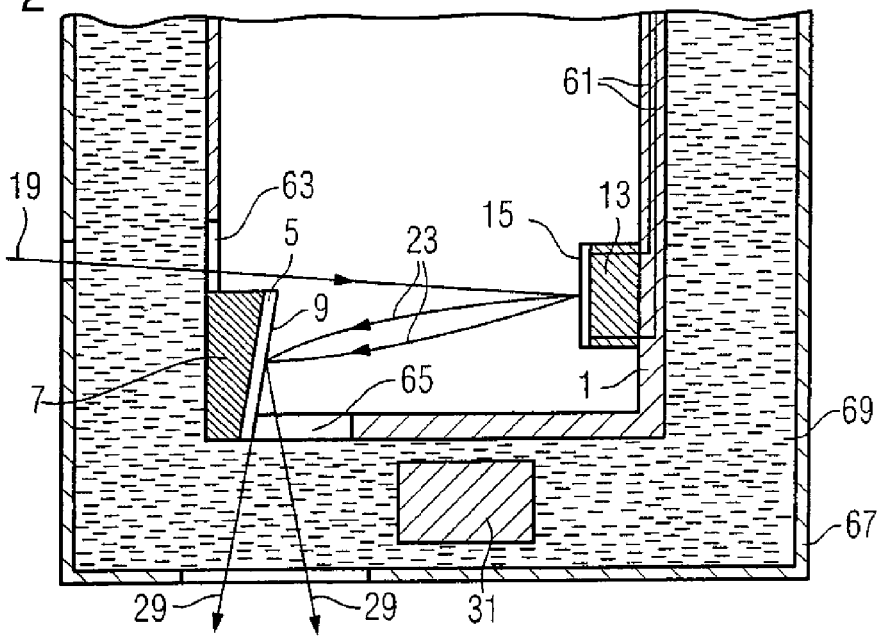
FIG. 2 is a longitudinal section through a portion of a further embodiment of the vacuum housing.

FIG. 2 shows a longitudinal section of a further cylindrical design of the vacuum housing 1. The cathode 11 has a surface 15 and a support layer 13 and is located entirely inside the vacuum housing 1. The laser beam 19 strikes the surface 15 of the cathode through an optically transparent window 63 that is located in the opposite base of the vacuum housing 1. So that the optical window does not lose transparency to any degree of severity in the course of the usage of the x-ray radiation, it can be protected by protective plates from clouding (fogging) with material that vaporizes during the operation of the x-ray radiator.

As in the embodiment shown in FIG. 1, the surface 15 of the cathode 11 can be heated by an electrical arrangement 61. The base temperature of the surface 15 of the cathode 11 thereby increases, such that less laser power is required in order to achieve the emission temperature. The surface 15 alternatively can be preheated optically (for example by a further laser beam) or inductively (by further magnetic fields) .

The electron beam 23 strikes the surface 9 of the anode 5 that is located on a support layer (substrate) 7 that transports the heat from the surface of the anode 9 to the outside of the vacuum housing. X-rays are emitted from the surface of the anode 9 through a region 65 of the vacuum housing that is transparent for x-rays. The entire vacuum housing 1 is surrounded by a radiator housing 67 that is filled with a coolant 69, such that an effective cooling of the entire system is ensured.

Figure 3:
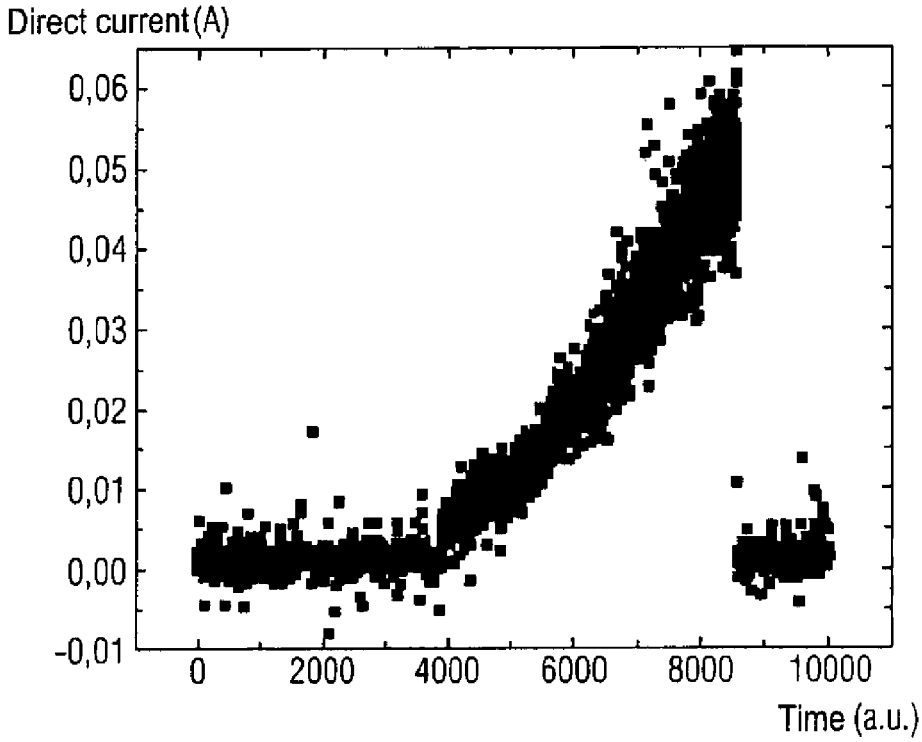
FIG. 3 is a plot of an exemplary measurement of electron emission in accordance with the invention.

An example of an experimentally determined electron emission achieved by irradiation of a rotary cathode with a continuous laser is shown in FIG. 3 as a plot of the electron current in amperes (A) over the time in arbitrary units (a.u.). Various measurement values are plotted as points in the diagram. The electron current thus rises (with the laser being operated with constant power until the laser is deactivated).

Figure 4:
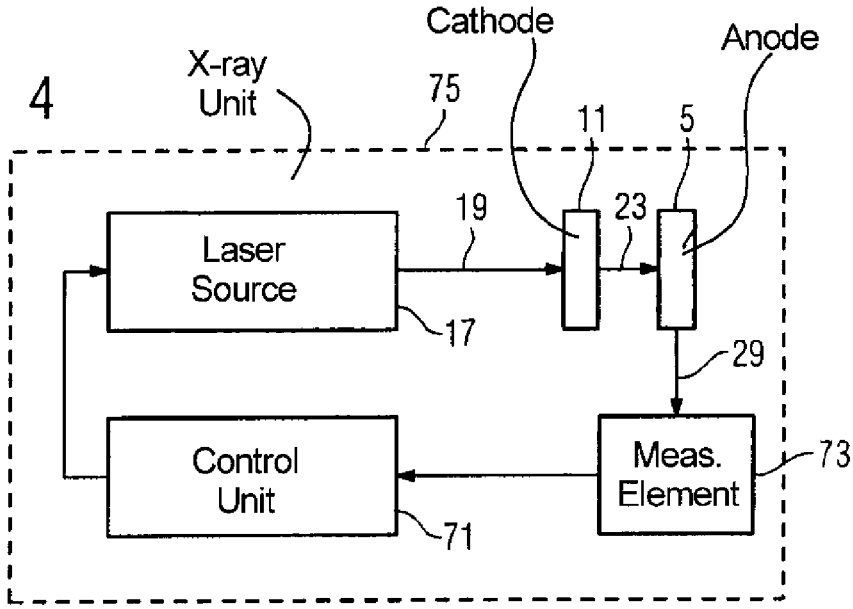
FIG. 4 is a block diagram of an embodiment of regulator circuit than can be used in the inventive x-ray unit.

FIG. 4 shows a block diagram of an x-ray unit 75 in which an x-ray radiator (for example from FIG. 1 or 2; here schematically represented using the cathode 11 and the anode 5) forms a regulatory circuit with a measurement element 73 for measurement of the flow of x-rays 29 in the radioscopy direction, a control unit 71 and a laser source 17. Not shown is a measurement element for measurement of the current between the cathode 11 and anode 5. The measurement outputs of the measurement elements 73 are connected with respective control inputs of the control unit 71. Control outputs of the control unit 71 are connected with the laser source 17. Alternatively, the control outputs can be connected with the drive for rotation of the tube envelope.

We claim as our invention:

1. A method for operating an x-ray radiator comprising the steps of:

irradiating a photocathode with a first beam power that causes emission of electrons from said photocathode;

directing said electrons emitted by said photocathode onto an anode to cause said anode to emit x-rays; and prior to irradiating said photocathode with said laser beam at said first beam power, preheating said photocathode by irradiating said photocathode with said laser beam at a second beam power that is temporarily increased compared to said first beam power, and blocking electrons emitted by said photocathode from reaching said anode while preheating said photocathode.

2. A method for operating an x-ray radiator comprising:

irradiating a photocathode with a laser beam emitted by a laser to cause said photocathode to emit electrons from an annular focal ring on a surface of the photocathode;

directing said electrons from said photocathode onto an anode to cause said anode to emit x-rays;

measuring a measuring quantity having an effective correlation to a temperature of the photocathode upon irradiation thereof by said laser beam; and automatically controlling deflection of said laser beam between said laser and said photocathode to deflect said laser beam laterally relative to said annular focal ring dependent on a relationship between said measurement quantity and a control value.

3. An x-ray unit for operating an x-ray radiator comprising:

a photocathode irradiated with a first beam power that causes emission of electrons from said photocathode;

a deflection arrangement that directs said electrons emitted by said photocathode onto an anode to cause said anode to emit x-rays; and prior to irradiating said photocathode with said laser beam at said first beam power, said photocathode being preheated by irradiating said photocathode with said laser beam at a second beam power that is temporarily increased compared to said first beam power;

a blocking unit that blocks electrons emitted by said photocathode from reaching said anode while preheating said photocathode.

4. An x-ray unit for operating an x-ray radiator comprising the steps of:

a photocathode irradiated with a laser beam emitted by a laser to cause said photocathode to emit electrons from an annular focal ring on a surface of the photocathode;

a deflection arrangement that directs said electrons from said photocathode onto an anode to cause said anode to emit x-rays;

a measurement unit that measures a measuring quantity having an effective correlation to a temperature of the photocathode upon irradiation thereof by said laser beam; and a control unit configured to automatically control deflection of said laser beam between said laser and said photocathode to deflect said laser beam laterally relative to said annular focal ring dependent on a relationship between said measurement quantity and a control value.

* * * * *